US007282644B1

(12) United States Patent
Alvey

(10) Patent No.: US 7,282,644 B1
(45) Date of Patent: Oct. 16, 2007

(54) AERIAL CABLE SPLICE CLOSURE

(75) Inventor: Stephen L. Alvey, San Angelo, TX (US)

(73) Assignee: Verizon Services Corp., Arlington, VA (US)

( * ) Notice: Subject to any disclaimer, the term of this patent is extended or adjusted under 35 U.S.C. 154(b) by 0 days.

(21) Appl. No.: 11/332,265

(22) Filed: Jan. 17, 2006

(51) Int. Cl.
*H01R 4/00* (2006.01)

(52) U.S. Cl. ..... 174/84 R; 174/92; 174/93

(58) Field of Classification Search ..... 174/74 R, 174/76, 80, 84 R, 88 S, 90, 91, 92, 93
See application file for complete search history.

(56) References Cited

U.S. PATENT DOCUMENTS 3,663,740 A * 5/1972 Dellett ..... 174/92
3,692,926 A * 9/1972 Smith ..... 174/92
4,135,587 A * 1/1979 Diaz ..... 174/92
4,438,294 A * 3/1984 Meltsch et al. ..... 174/88 R
4,558,174 A * 12/1985 Massey ..... 174/92
4,666,537 A * 5/1987 Dienes ..... 156/48
4,704,499 A * 11/1987 Faust ..... 174/92
4,857,672 A * 8/1989 Rebers et al. ..... 174/93
4,933,512 A * 6/1990 Nimiya et al. ..... 174/92
5,007,701 A * 4/1991 Roberts ..... 385/53
5,245,133 A * 9/1993 DeCarlo et al. ..... 174/93
5,825,961 A * 10/1998 Wilkins et al. ..... 385/135
6,107,571 A * 8/2000 Damm ..... 174/74 R

* cited by examiner

*Primary Examiner*—William H. Mayo, III

(57) ABSTRACT

When making splices of communication cables above ground, a protective closure can be placed around the cable at the location of the splice, thereby protecting the splice from the elements. Rubber walls at either end of the protective closure, which otherwise form a sealed closure, may be breached by wind and/or animals desiring a habitat. A protective shield is affixed to the outside of each of the rubber end walls, at both ends of the closure, to protect the rubber end walls and thereby prevent the closure from being breached. The shield is non-conductive and can be made from plastic.

6 Claims, 3 Drawing Sheets

AERIAL CABLE SPLICE CLOSURE

BACKGROUND OF THE INVENTION

1. Field of the Invention

The present invention relates to aerial closures used for protecting cable conductor splices from the elements and, more particularly, to an improvement which inhibits penetration of those closures by the elements such as wind and/or by animals.

2. Description of Prior Art

In this modern world of improved communication, it is commonplace to see cables stung on poles, high above ground. These cables can be used for TV, telephone, fax, and/or Internet communication, etc. Oftentimes, cables have to be spliced in the field to accommodate changes that were not contemplated when the cables were initially installed. Splicing cables is not only a challenging endeavor when they are elevated high above ground, i.e., "aerial" cables, but since that splice represents a point of relative fragility or sensitivity with respect to the rest of the cable which has not been altered, protection of that splice is very important. Clearly, when communication services go down because of cable failure resulting from a splice that has deteriorated or completely failed, that causes significant aggravation for any consumer whose communication service has been interrupted.

Aerial cable splice closures/terminals are commercially available. One company, 3M, supplies a model known as the "3M SliC Splice Case" or "3M Slic Closure/Terminal". A major drawback to this terminal is that it uses rubber ends or walls to seal the cable to the closure (thereby forming an "enclosure") and the rubber walls are not always completely impervious to wind and/or to animals. The rubber walls, particularly near outer edge of the wall closest to the body of the splice closure, tend to work their way out of the closure over time, resulting from movement back and forth during windy conditions. That, in combination with birds or other animals which tend to chew on the loose rubber and pull it apart, can result in a major breech of the rubber walls, exposing the splice to the elements such as wind-swept rain. Moreover, it is not unusual to discover that animals, such as squirrels, bats and/or birds, were living inside the enclosure. While inside, they can do further damage to the splice. Therefore, there is a need for an improved aerial closure which solves these problems.

SUMMARY OF THE INVENTION

Embodiments of the present invention include an improved aerial closure used for protecting a splice made between two cable conductors. The closure includes a latchable plastic case having two open ends for encompassing (installing around) both the splice and attached portions of the two cable conductors. The closure further includes rubber walls for sealing the two open ends, and converting the closure into an enclosure. In one embodiment, the rubber walls are made by spiraling rubber wrap around each one of the attached portions of the two cable conductors at each one of the open ends until the open ends are sealed. The improvement comprises non-conductive protectors, one of the protectors being affixed to the outside of each one of the rubber walls to prevent penetration into the enclosure through the rubber walls by wind and/or by animals.

In a further feature of the present invention the protectors are plastic plates which are configured to conform to the shape and size of the outside of the rubber walls. The shape of the outside of the rubber walls can be circular. If they are circular, the plastic plates are comprised of two semi-circular plate pieces, each piece having a semi-circular hole formed at the center of the piece. The hole is sized to accommodate there-through one of the attached portions of the two cable conductors.

In another feature, the invention includes two semi-circular plate pieces each have arcs of concentric circle break-away perforations for permitting a cable installer/technician to break away portions of the plate pieces at the perforations to accommodate larger or thicker cable conductors, as may be required. The plate pieces can be affixed to the outside of the rubber walls by peel and stick adhesive tape. The protection may be virtually complete, where substantially the entire outside of the rubber walls is protected by the protectors whereby virtually no portion of the outside of the rubber walls remains visible.

DETAILED DESCRIPTION OF THE PREFERRED EMBODIMENTS

Figure 1:
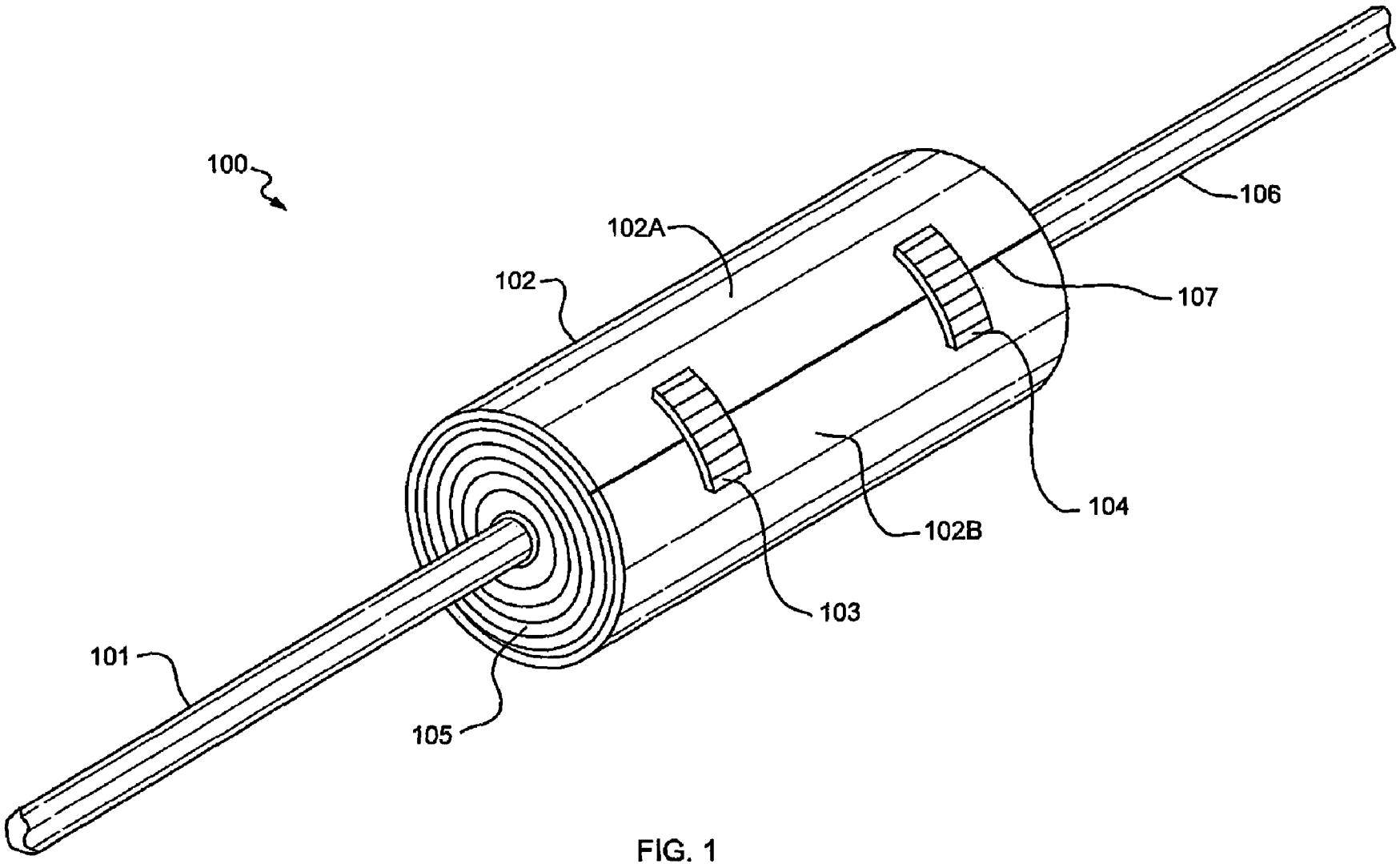
FIG. 1 (PRIOR ART)
FIG. 1 depicts an exemplary cable splice closure of the type that is used in the prior art.

FIG. 1—Cable Splice Closure

Referring to FIG. 1, there is depicted aerial cable closure system 100 with spliced cable contained therein. Cable 101 is spliced to cable 106 and that splice is not visible in this Fig. because it is contained within closure body 102. Cable 101 and 106 may be equivalent cables which are equally-sized, or they may be physically or electrically different from each other. Detail about the cable(s) or the nature of the splice of the cables is not material to the present invention. Closure body 102 is typically a plastic material, and is not an electrically conductive material.

Closure body 102 had been in an open state (not shown), when the cable splice was initially positioned therein. After inserting/positioning the splice, closure body 102 was closed and latched by a cable installer/technician using latches 103 and 104. In reverse operation, closure body can be opened by a cable installer/technician who releases latches 103 and 104. On the opposite side from seam 107 on closure body 102 (hidden from view), a hinged mechanism or the equivalent permits closure sections 102A and 102B to be opened (separated) and closed relative to each other, where those sections rotate about the axis of the hinged mechanism while being opened or closed.

The outside of rubber wall 105 is shown at an end of closure body 102. It is formed by spiraling a rubber wrap or strip (not shown in detail, but approximately 2 inches wide and one-half inch thick around that portion of cable 101 that is located at that end of closure body 102. The resulting rubber wall, constructed of the spiraling rubber strip, has a generally circular shape. When sufficient rubber is applied to form a complete wall, it is held in place by wrapping an adhesive tape around the wall circumference. The rubber wrap and the tape can be applied to that end of the cable while closure sections 102A and 102B are in an opened state. While in that opened state, a similar rubber wall (not visible in this view) is constructed at the other end of closure body 102. When both rubber walls are built, closure sections 102A and 102B are closed and latched using latches 103 and 104. The closure sections clamp-down on both rubber walls which have resilience and compress, since the walls are made of rubber. This resulting enclosure around the cable splice is intended to form a safe and moisture-proof environment for the splice.

However, as noted, rubber wall 105 and its companion (not visible) at the other end of closure body 102 are not sufficiently robust to withstand certain environmental challenges, for example excessive wind and/or animals picking at the rubber walls. Applicant offers a solution to this problem.

Figure 2:
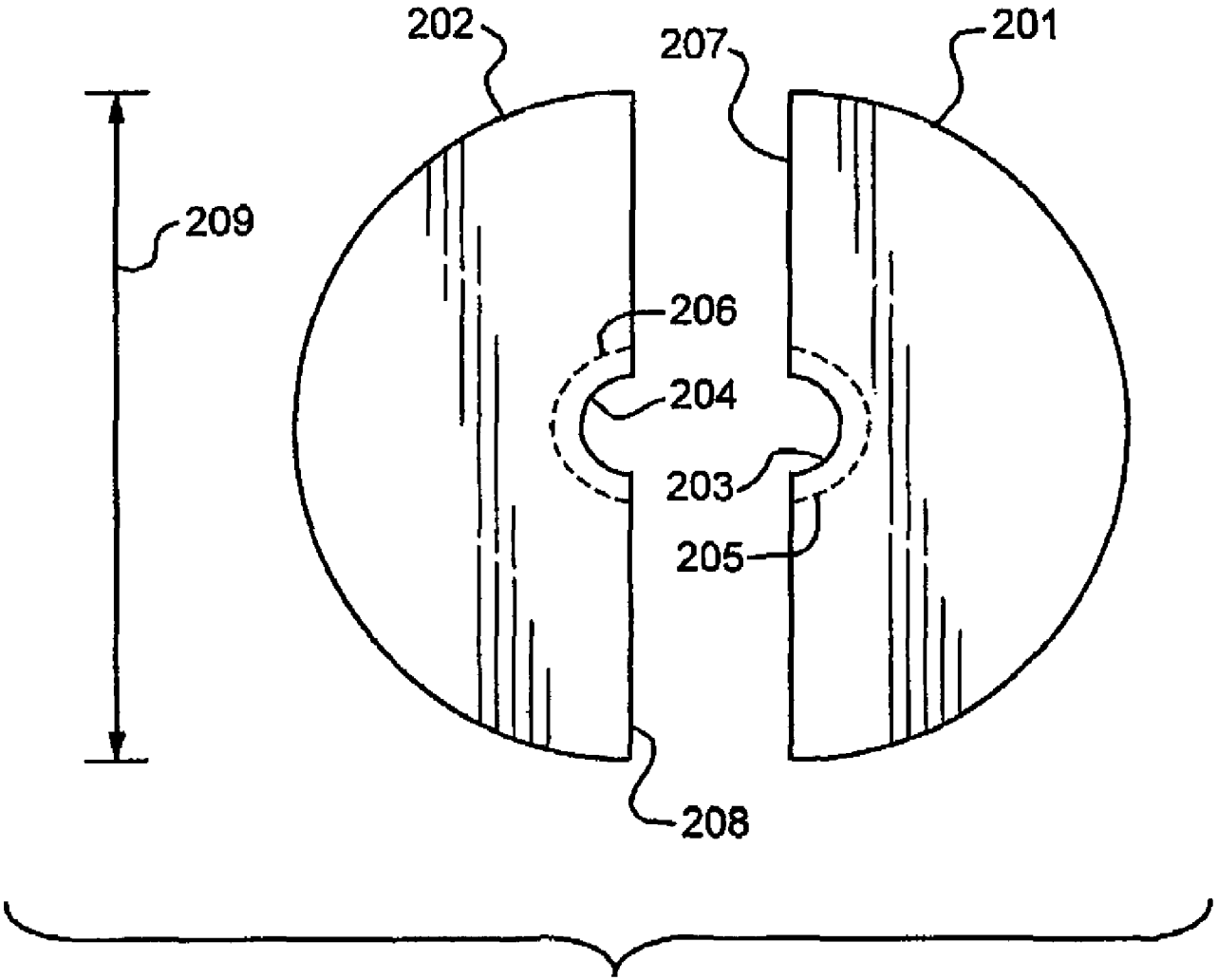
FIG. 2 depicts protective plates to be used with the closure of FIG. 1 in accordance with principles of the present invention; and, FIG. 3 depicts the closure of FIG. 1 after application of the protective plates of FIG. 2, in accordance with principles of the present invention.

Referring to FIG. 2, an electrically non-conductive protector is depicted. Protector plate pieces 201 and 202 are shown, in a semi-circular shape to conform to the circular shape of rubber wall 105. Protector plates or plate pieces 201 and 202 can be made of any non-conductive material, and generally are formed from hard plastic. In a particular embodiment, protector plates 201 and 202 have peel and stick tape (not shown) affixed to one of their sides. The tape is intended to adhere to rubber wall 105 when the protector plates are put in place. Protector plate piece 201 has a semi-circular cutout 203 at its center. Likewise, protector plate piece 202 has an equally-sized semi-circular cutout 204 at its center. The diameter of the cutouts approximate the diameter of the cable with which the cutouts are to be mated, e.g., cable 101. Dimension (diameter) 207 is substantially equal to the diameter of rubber wall 105. Protector 201/202 has been informally dubbed by its inventor—the "AlveSeal."

Figure 3:
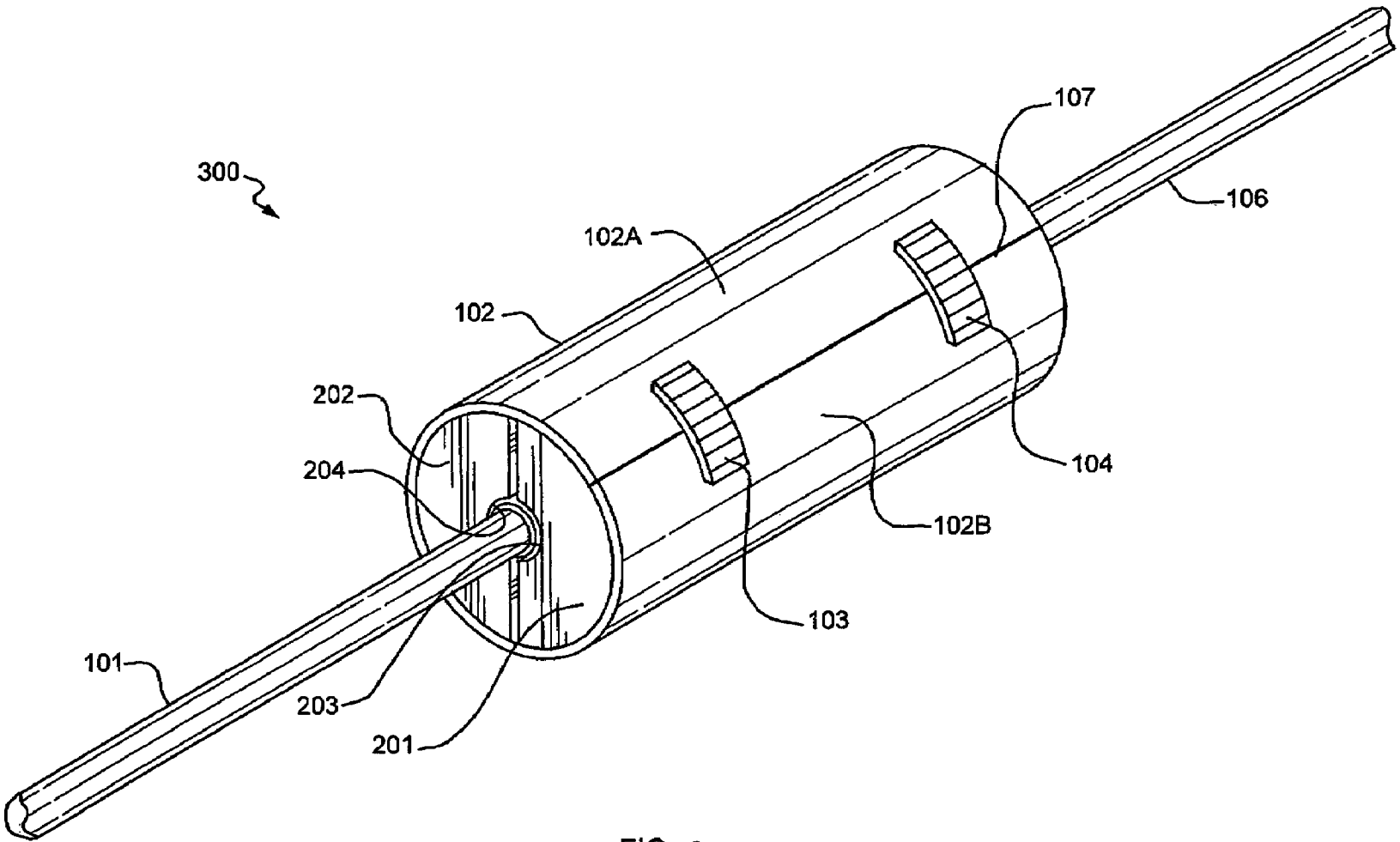

Referring to FIG. 3, aerial cable closure system 300 is identical to aerial cable closure system 100 depicted in FIG. 1, except for the salient difference of showing the protective plates of FIG. 2 in their proper position on the outside of rubber wall 105. In this view, protective plates 201 and 202 are shown affixed to the outside of rubber wall 105 in a manner that edges 207 and 208 do not touch. The outside of rubber wall 105 is visible between those edges. A similar pair of protective plates are affixed to the other rubber wall (not visible in this view).

In operation, the installer/technician selects an appropriately sized pair of protector plates such as plates 201/202 from his inventory of protectors. The diameter dimension 209 should match or approximate the outside diameter of the rubber wall and the diameter of the semi-circular holes 203/204 should match or approximate the outside diameter of the cable to which the protector plates are to be applied. If the outside dimension 209 is appropriate, but the inside holes 203/204 are too small to fit around the cable, the installer/technician can press against perforations 205/206 and punch-out portions of protectors 201 and 202 to make the inside hole larger. There can be several arcs of concentric circle perforations (only one arc being shown in FIG. 2) at different hole-size locations, so that the installer/technician can readily select the size of the hole desired.

After the protector plates are selected and prepared as described above, the stick and peel tape affixed to the protectors is peeled to expose the sticky adhesive (not shown). Then, the plastic protectors are simply fitted over the protruding cable, e.g., cable 101 and pressed against rubber wall 105 to which the protector plates adhere. Protector plates 201 and 202 are positioned over cable 101 and against rubber wall 105 in a manner so that edges 207 and 208 are close or abutting, whereby protector plates 201 and 202 may cover all or substantially all of the outside of rubber wall 105. In certain instances, if the inside hole dimension is too large relative to the cable diameter, edges 207/208 may move beyond an abutting position and may overlap slightly, particularly if protectors 201 and 202 are slightly larger than the rubber wall, where "wiggle" room is needed. In such an instance, substantially all of rubber wall 105 is protected.

The most important section of rubber wall 105 to protect is its outer periphery section, nearest closure body 102. This section has proven to be the most likely section of the rubber wall to loosen first. Therefore, protector plates 201/202 should be positioned so that the periphery of rubber wall 105 is protected, leaving a small portion of rubber wall closest to cable 101 exposed, if need be. In the ideal circumstance, the entirety of rubber wall 105 is virtually completely covered by plates 201 and 202. When protectors, such as protector 201/202, are in place on the outsides of both rubber walls on both ends of closure 102, the resulting enclosure becomes far more resistant and impervious to wind and animals than is previously had been.

While several illustrative embodiments of the present invention have been shown and described, numerous variations and alternative embodiments may occur to those skilled in the art. For one example, the outer periphery of protective plates 201 and 202 can be made to match substantially completely the outline of the ends of the body of the closure, when the closure is latched. Accordingly, the outside edge of the rubber wall that is being compressed by the body of the closure when latched is being completely protected by the plates while straight edges 207/208 are made to overlap, whereby the protective plates completely cover the outside of the rubber wall.

For another example, the ends of the body of the closure can have grooves designed therein, if not already in place, to receive the outer peripheries of protective plates 201 and 202 when the closure is latched closed, thereby offering stronger protection. This idea requires a slightly oversized pair of protective plates (relative to the size of the compressed rubber wall) in order for the plates to fit into the grooves. Again the protective plates completely cover the outside of the rubber wall.

For yet another example, other than peel and stick adhesive can be used; other adhesive can be applied directly to each rubber wall and/or to the protectors if such other adhesive proves to be more reliable than the peel and stick adhesive currently being used.

For still yet another example, variations in protector plate thickness, protector plate material, etc. can be made into different protector plate models; these different models can be used in different geographical areas where climate variations might make one model more suitable than another (e.g., Alaska is frigid most of the year and southern Florida is humid and hot most of the year.) For closures that may have shapes other than those illustrated with circular ends, protector plates 201/202 can be made to conform to these other shapes. Perforated stress lines can be included on the protector plates other than the concentric arc perforations discussed above to accommodate other than circularly-shaped protective plates. Such variations and alternative embodiments are contemplated, and can be made without departing from the spirit and scope of the present invention as defined in the appended claims.

What is claimed is:

1. An improved aerial closure used for protecting a splice made between two cable conductors, said closure including a latch-able plastic case having two open ends for encompassing both said splice and attached portions of said two cable conductors, and further including rubber walls for sealing said two open ends to convert said closure to an enclosure, said rubber walls made by spiraling rubber wrap around each one of said attached portions of said two cable conductors at each one of said open ends until said open ends are sealed, wherein the improvement comprises:

non-conductive protectors, one of said protectors being affixed to the outside of each one of said rubber walls to prevent penetration into said enclosure through said rubber walls by wind and/or by animals.

2. The improvement of claim 1 wherein each of said protectors is comprised of plastic plates configured to conform to the shape and size of said outside of said rubber walls.

3. The improvement of claim 2 wherein said shape of said outside of said rubber walls is circular and said plastic plates are comprised of two semi-circular plate pieces, each piece having a semi-circular hole formed at the center of said piece, said hole being sized to accommodate there-through one of said attached portions of said two cable conductors.

4. The improvement of claim 3 wherein said two semi-circular plate pieces each have arcs of concentric circle break-away perforations for permitting a cable installer/technician to break away portions of said plate pieces at said perforations to accommodate larger cable conductors, as may be required.

5. The improvement of claim 4 wherein said plate pieces are affixed to said outside of said rubber walls by peel and stick adhesive tape.

6. The improvement of claim 5 wherein substantially all of said outside of said rubber walls is protected by said protectors whereby virtually no portion of said outside of said rubber walls remains visible.

* * * * *